US007766614B2

(12) United States Patent
Northfield

(10) Patent No.: US 7,766,614 B2
(45) Date of Patent: Aug. 3, 2010

(54) COMPRESSOR CASING

(75) Inventor: Quinten J. Northfield, Bromley (GB)

(73) Assignee: Rolls-Royce plc, London (GB)

( * ) Notice: Subject to any disclaimer, the term of this patent is extended or adjusted under 35 U.S.C. 154(b) by 679 days.

(21) Appl. No.: 11/711,040

(22) Filed: Feb. 27, 2007

(65) Prior Publication Data

US 2007/0212217 A1 Sep. 13, 2007

(30) Foreign Application Priority Data

Mar. 10, 2006 (GB) ..... 0604844.1

(51) Int. Cl.
*F04D 29/44* (2006.01)

(52) U.S. Cl. ..... 415/200; 415/196

(58) Field of Classification Search ..... 415/200, 415/196, 197, 58.6, 58.7, 57.1, 54.1
See application file for complete search history.

(56) References Cited

U.S. PATENT DOCUMENTS 4,063,848 A * 12/1977 Wiggins et al. ..... 415/206
6,648,591 B2 * 11/2003 Collins ..... 415/58.5

FOREIGN PATENT DOCUMENTS

| | | |
|---|---|---|
| GB | 2 289 720 A | 11/1995 |
| GB | 2 361 747 A | 10/2001 |
| GB | 2 363 167 A | 12/2001 |
| GB | 2 373 024 A | 9/2002 |
| GB | 2 407 343 A | 4/2005 |
| WO | WO 95/34745 | 12/1995 |

* cited by examiner

*Primary Examiner*—Edward Look
*Assistant Examiner*—Dwayne J White
(74) *Attorney, Agent, or Firm*—Oliff & Berridge, PLC

(57) ABSTRACT

A compressor or fan casing is provided with a casing treatment to improve the surge margin of an unshrouded rotor stage. The casing treatment takes the form of an insert (20) let into the casing wall (10) to provide a plurality of re-circulation grooves (22) in the wall circumscribing the path of the rotor blade tips. The insert consists of a plurality of arcuate insert segments (20) made of a carbon fiber reinforced resin. In the preferred construction each arcuate segment (20) is formed with axially extending tangs (28,29) on either side that are received into the correspondingly shaped sides (38, 40) of a receiving channel (16) in the casing wall (10). The casing (10) may be split on a diametric plane, thus exposing groove ends (38,40), into which the tangs (28,29) carried by the inserts (20) can be slid before the casing (10) is finally assembled.

4 Claims, 2 Drawing Sheets

COMPRESSOR CASING

BACKGROUND

The invention relates to gas turbine engines and more particularly to a compressor casing insert.

It is known to improve the surge margin of a gas turbine engine compressor by applying a casing treatment to the casing wall, otherwise modifying the casing wall, in the vicinity of the tips of a rotary stage to remove or modify the behaviour of boundary layer airflow in the vicinity of the rotor blades. By this means the condition of compressor stall or compressor surge is alleviated or prevented from developing. A common factor in treatments of this kind is the provision of means that allows boundary layer circulation in circumferential or axial directions or both. Such means essentially comprises a flow path let into the casing wall with open access to the boundary layer on the compressor stage wall.

SUMMARY

The present invention concerns a casing treatment in which a plurality of annular, or circumferentially extending, channels are provided in the compressor casing wall.

According to a first aspect of the present invention there is provided a gas turbine engine rotary compressor casing comprising an outer wall of the casing forming a compressor flow path surrounding a rotor of unshrouded blades in the vicinity of the tips of the unshrouded blades is provided with a casing treatment in which a plurality of annular, or circumferentially extending, channels are provided in the compressor casing wall, wherein the said channels are provided in an insert circumscribing the blade tips characterised in that the insert is formed of fibre reinforced composite material According to a further aspect of the present invention the compressor casing is further characterised in that the insert comprises a plurality of fibre reinforced composite material segments.

BRIEF DESCRIPTION OF THE DRAWINGS

The invention and how it may be carried into practice will now be described in more detail with reference by way of example to a particular embodiment illustrated in the accompanying drawings, in which.

DETAILED DESCRIPTION OF EMBODIMENTS

Figure 1:
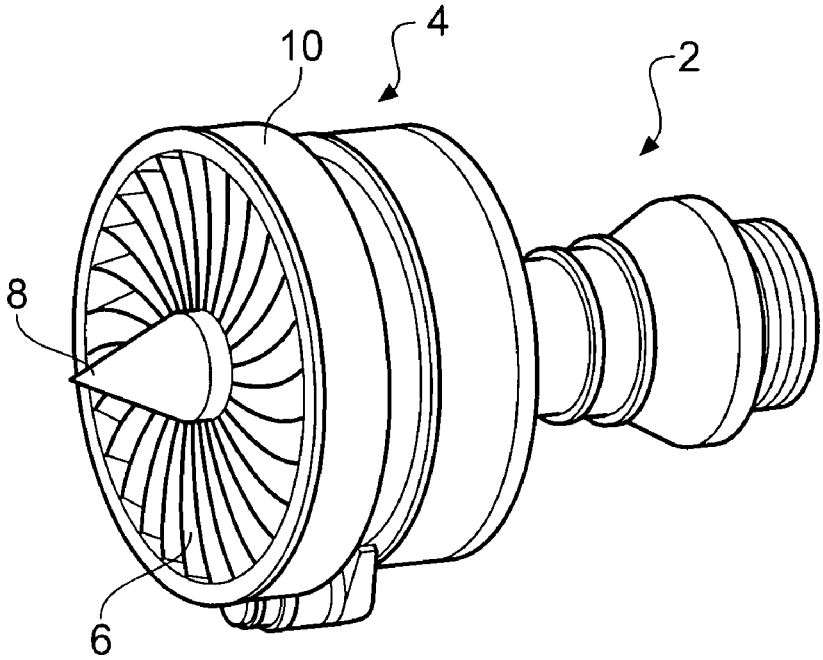
FIG. 1 is a perspective view of a gas turbine turbofan engine.

A gas turbine turbofan engine having a high by-pass ratio of the kind used to power commercial airliners and transport aircraft is illustrated in FIG. 1 as an example only of one type of engine in which the invention may be used. It is to be understood that it is not intended thereby to limit use of the invention to engines of that type. The invention will find application in turbojet engines in which bypass ratio is very much less than a turbofan. Nor is it intended by illustrating an axial flow engine to exclude the invention from use with radial flow engines. Furthermore since the invention is concerned with arrangements dealing with airflow through a compressor stage it need not inevitably be part of an engine and could be simply a rotary compressor or fan stage.

As illustrated in FIG. 1 the engine shown comprises a core, axial flow combustion section generally indicated at 2 and a fan section 4. The fan section 4 comprises a multiplicity of unshrouded fan blades 6 mounted around the periphery of a rotor disc 8 housed within a fan case 10. The fan case 10 is generally cylindrical or annular and its inner surface defines the radially outer wall of the flow path through the fan stage. The inner surface 12 of the case 10 is spaced by a running clearance "x" from the radially outer tips 14 of the rotor blades 6. The distance "x" is selected according to several factors and varies throughout an engine cycle mainly according to rotational speed. A build clearance is selected to ensure that the blade tips 14 do not rub the casing inner surface 12 when the engine is stationary or turning at low speed. As engine speed increases the clearance tends to reduce due to creep in the length of the blade under the influence of centrifugal forces, thermal effects on the face case and the rotor blades also have to be taken into account.

The efficiency of the fan rotor is influenced partly by the size of the gap "x". In general, the greater the clearance distance over the tips of the blades, the greater is the over tip leakage which lowers stage efficiency. In some instances in order to achieve the lowest practical clearance gap "x" the initial build clearance is set so that a tip rub is achieved at a predetermined engine speed. In such cases a sacrificial insert is set into the fan case wall arranged to contact the blade tips 14 which then cut a track in the insert surface. Another important fan performance factor is surge margin. Fan surge is caused by the onset of stall conditions, or complete flow reversal, of airflow through the fan or compressor. One variable that contributes to the onset of a fan surge is the variation of airflow speed across the airflow path. Towards the radially outer casing wall the airflow speed falls rapidly due to the boundary layer effect at the wall surface 12. To combat these effects the casing wall may be designed with so-called casing treatments that remove or re-circulate a proportion of the boundary layer, thus delaying or preventing onset of the airflow stall conditions. One such casing treatment of this kind is shown in FIGS. 2 and 3, and will now be described in more detail.

Figure 2:
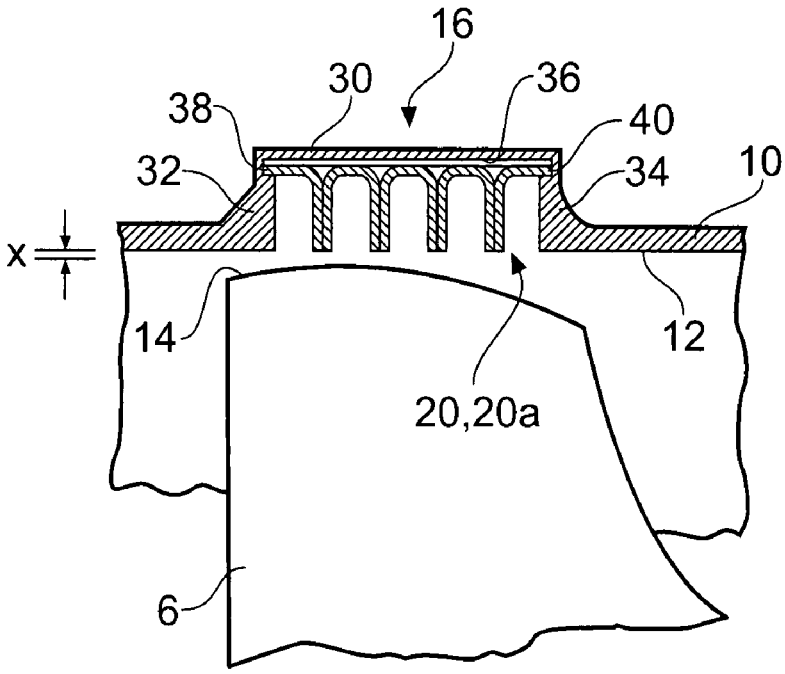
FIG. 2 is a detail view on a section 2-2 in FIG. 1.
Figure 3:
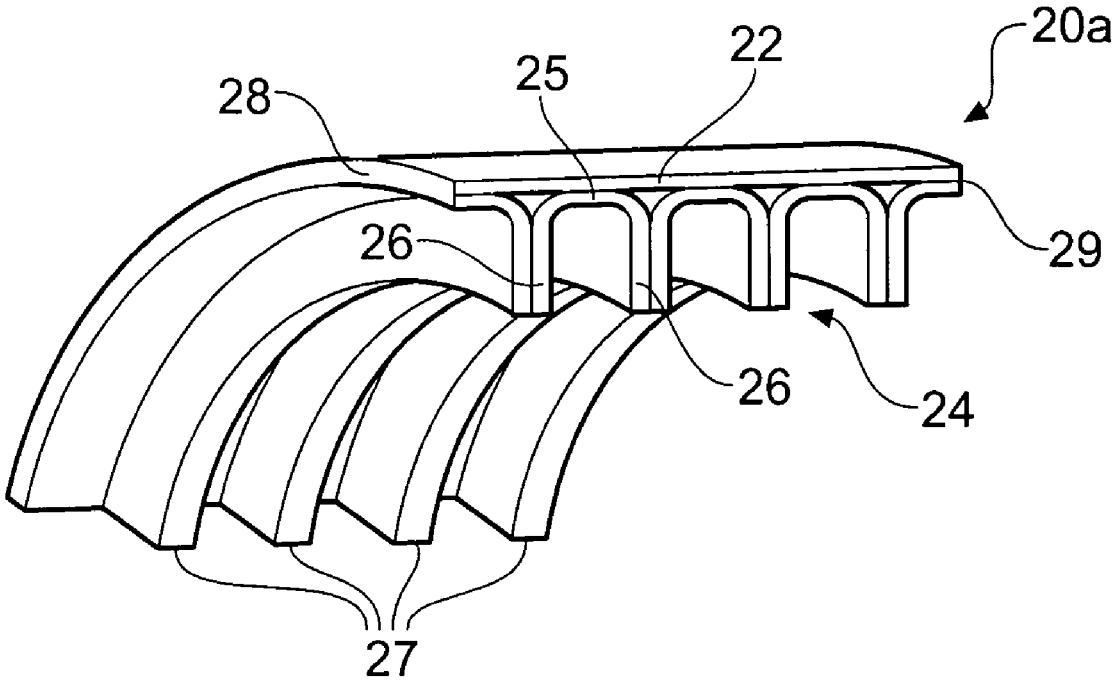
FIG. 3 is a perspective view of an insert segment constructed in accordance with the present invention.

Referring now to FIGS. 2 and 3 the casing treatment consists of a plurality of annular or circumferentially extending channels formed in the wall of the compressor or fan casing. Individual channels are therefore defined by a series of circumferentially extending ribs or hoops, and in use these are subject to erosion and/or abrasion. Consequently it is preferable is the component or components providing the casing treatment are replaceable, indeed easily replaceable.

In accordance with the present invention the component that provides the casing treatment comprises an annular insert 20 let into the fan case wall 10 at a position circumscribing the unshrouded tips of the rotor blades 6. The insert 20 provides a plurality of circumferentially extending grooves or channels, one of which is indicated at 22, which provide a circulatory path let into fan casing wall 10. Each of the grooves 22 is separated from its neighbours by a circumferential wall or rib 24, otherwise there are no obstructions in the circumferential paths of grooves 22. The tops of the groove walls or ribs 24 may be finished either level with the inner surface 12 of the compressor casing or recessed relative thereto depending on the selected style of overtip leakage control selected for the compressor design. In the case that the compressor design calls for the tips of the compressor blades to run in a trench (not shown) then the tops of the groove walls 24 will be slightly recessed relative to the level of the inner surface 12 of the compressor wall 10. In either case the design may allow for wear contact between the blade tips and the tops of the ribs 24 in order to wear a tip clearance track for optimum tip clearance. The design, materials and construction of the insert segments are thus of importance. The segments are designed not only to implement the selected casing treatment but also to permit easy mounting in the compressor casing. In the preferred embodiments the insert comprises a plurality of fibre reinforced composite material segments mounted in the casing in end-to-end relationship.

Referring to FIGS. 2 and 3, the wall 10 of the compressor casing is formed with an annular recess generally indicated at 16 which comprises an annular base portion 30 stepped radially outwards from the casing inner wall surface 12 and annular side portions 32, 34 that join the base portion 30 with the casing wall 10. The inner surface 36 of base portion 30 is stepped outward from the line of the inner surface 12 of the compressor casing 10 approximately by the radial depth of the annular insert 20. Thus, there is formed an annular recess of essentially rectangular cross-section circumscribing the tip path described by the rotor blades.

In this particular embodiment the annular insert 20 consists of a plurality of arcuate segments 20*a*, one of which is shown in more detail in FIG. 3. The base of the casing recess 16 and individual recess segments are correspondingly adapted to engage one with the other to positively locate the insert segments 20*a* within the recess 16. The recess side walls 32, 34 are undercut adjacent the inner surface 36 of the recess base layer 30, thus forming opposing grooves 38, 40 at either side of the recess 16. Each arcuate insert segment 20*a* is made up of an arcuate base layer 22 with a plurality of U-shaped corrugations indicated by arrow 24 formed on the radially inner, curved face of the base layer 22. The base portions 25 of the U-shaped corrugations 24 lie against the base layer 22 with the upstanding limbs 26 of neighbouring U's lying against each other forming a series of parallel arcuate ribs 27. At either arcuate side edge the insert base layer 22 and a part of the base portion 25 of the corrugations at the edges extend outwards to form arcuate tangs 28, 29 at either side of a segment. The radial depth of these tangs 28, 29 is dimensioned to fit within the grooves 38, 40. The radius of curvature of the arcuate tangs 28, 29 of the insert segments is made to match the radius of the recess grooves 38, 40 thus the one is adapted to engage the other thereby to locate the insert segments in the in the compressor casing.

The compressor casing 10, in this embodiment, is formed in two opposing halves on opposite sides of a diametric plane. Thus, when the casing is split, open ends of the insert recesses in either half are exposed to allow the casing treatment inserts to be mounted in the recesses in each casing half. Each insert segment is loaded into a recess by engaging the tangs 28, 29 with the recess grooves 38,40 and sliding the inserts into position in end-to-end relationship in the recesses. When the casing halves are secured together, the ends of the grooves and recesses are thereby closed and in register.

The insert segments in the described example are made of a reinforced composite material, by an appropriate method of manufacture. The segments may be manufactured by means of any suitable process; for example by compression moulding or by a conventional resin transfer moulding process. In a compression moulding process short glass fibre strands are mixed with a resin system to form a moulding compound which can be preformed into a required shape and then placed in closed mould tooling and compressed into the final shape. In a resin transfer process preforms, i.e. appropriately shaped, carbon fibre reinforced sections or pieces are laid up in a mould and impregnated with a high temperature resin, such as bismaleimide. Other resin systems may be suitable, subject to their temperature capabilities being compatible with the operating parameters of the compressor. The preforms are pre-cut lengths of woven mat or fibre plies pressed into the shape of the finished part, there may be several such layers. Alternatively, a resin mixture containing a homogeneous distribution of chopped fibres is injected directly into a mould the cavity of which is formed in the shape of the finished arcuate segment.

In the preferred form of the invention the method for making the arcuate insert segments comprises the steps of providing an arcuate former having a plurality of upstanding ribs, wherein the number of spaces between former ribs corresponds to the number of ribs of a finished insert; providing a plurality of carbon fibre plies containing stabilizer composition of sufficient tackiness to hold the fibre plies on the former ribs;laying up a base layer of fibre plies over the shaped ribs and ensuring that plies at both arcuate edges extend outwards to form the arcuate mounting tangs. The assembly is then impregnated with a high temperature resin system such as bismaleimide resin and is debulked and cured in accordance with normal practice to produce a finished carbon composite component. If the insert design calls for the insert ribs to be abraded by the rotor tips, the said ribs may be left as parent carbon composite material or further abradable material may be locally bonded to the side and end faces of the ribs. In the various manufacturing processes mentioned above the parent material is suitable for use as abradable material, that is no further special additives are necessary. Other manufacturing processes and material may be suitable, these example are not intended to be exclusive.

The invention claimed is:

1. A gas turbine engine rotary compressor casing comprising:

an outer wall of the casing forming a compressor flow path surrounding a rotor of unshrouded blades in the vicinity of tips of the unshrouded blades is provided with a casing treatment in which a plurality of annular, or circumferentially extending, channels are provided in the compressor casing wall, wherein the channels are provided in an insert circumscribing the blade tips, wherein the insert is formed of fibre reinforced composite material and further comprises a plurality of arcuate fibre reinforced composite material segments mounted with an annular formation in said compressor casing wherein each segment of the insert is formed with tangs adapted to engage complementary formations in the compressor casing.

2. A gas turbine engine rotary compressor casing as claimed in claim 1 wherein the tangs are formed at either side of a segment.

3. A gas turbine engine rotary compressor casing as claimed in claim 1 wherein the fibre reinforced composite material insert is formed with a plurality of circumferentially extending parallel ribs.

4. A gas turbine engine rotary compressor casing as claimed in claim 3 wherein the circumferentially extending parallel ribs are formed by upstanding adjacent limbs of lengths of fibre reinforced composite material moulded into pieces having a U-shaped cross-section.

* * * * *